US005315079A

United States Patent [19]

Gierut

[11] Patent Number: 5,315,079

[45] Date of Patent: May 24, 1994

[54] PCB MOUNTED 6PDT SLIDE SWITCH

[75] Inventor: Joseph J. Gierut, Glenview, Ill.

[73] Assignee: Illinois Tool Works Inc., Glenview, Ill.

[21] Appl. No.: 236

[22] Filed: Jan. 4, 1993

[51] Int. Cl.[5] ..... H01H 15/00

[52] U.S. Cl. ..... 200/16 D; 200/16 C; 200/18; 200/547; 200/548; 200/549; 200/550

[58] Field of Search ..... 200/547, 548, 549, 550, 200/345, 241, 243, 245, 246, 247, 252, 257, 5 R, 17 R, 18, 16 R, 16 A, 16 C, 16 D

[56] References Cited

U.S. PATENT DOCUMENTS

| | | | |
|---|---|---|---|
| 4,072,839 | 2/1978 | Spedale | 200/295 |
| 4,139,746 | 2/1979 | Farrell et al. | 200/16 |
| 4,352,966 | 10/1982 | English et al. | 200/16 D |
| 4,680,433 | 7/1987 | MacAdam | 200/16 D |

*Primary Examiner*—Henry J. Recla
*Assistant Examiner*—David J. Walczak
*Attorney, Agent, or Firm*—Schwartz & Weinrieb

[57] ABSTRACT

A PCB mounted 6 PDT slide switch is formed of a specially-designed cover/actuator sub-assembly and a base assembly which remain in assembly independent of each other. The slide switch includes a base member, a slide actuator member, a plurality of movable contact shoes, a separate spacer bar member, and a cover member.

20 Claims, 4 Drawing Sheets

FIG. 1
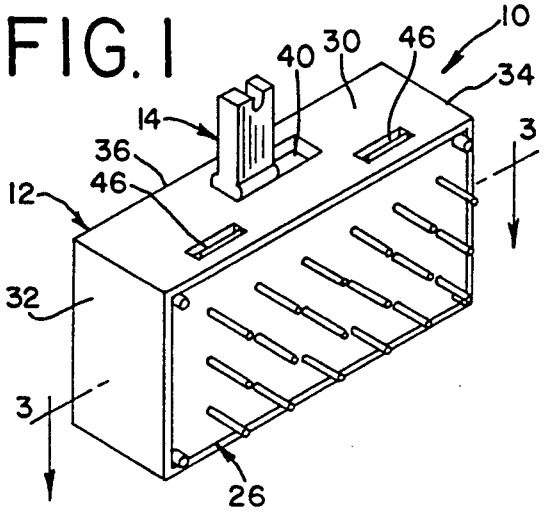
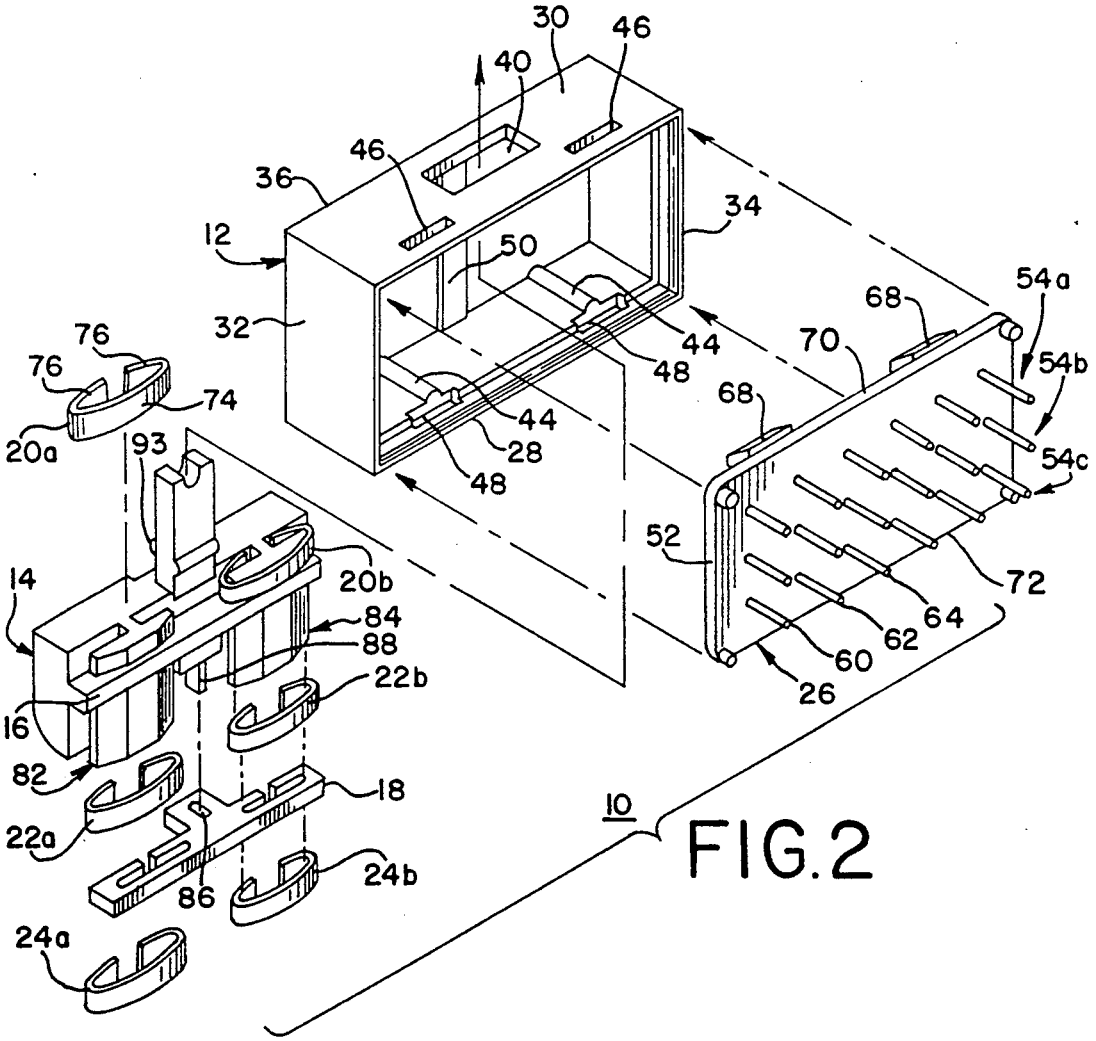
FIG. 2

PCB MOUNTED 6PDT SLIDE SWITCH

BACKGROUND OF THE INVENTION

This invention relates generally to slide switch constructions and more particularly, it relates to a PCB mounted 6PDT slide switch formed of a specially-designed cover/actuator sub-assembly and a base assembly which remain in assembly independent of each other.

As is generally well-known in the art, there exists electrical slide switches having a slide member, which is slidably positionable to affect a switching action. These prior art slide switches have been found to be useful in a wide range of electrical switching applications, such as in small tools and appliances. For most applications, there have been encountered installation problems in such slide switches since the terminals therein are normally required to be soldered to lead wires, a printed circuit (PC) board and the like when used in a circuit. Such operations may result in causing contamination which will adversely affect the switching operating characteristics. For instance, the heat applied during the soldering processes can cause oxidation or other contamination of the contact surfaces to occur so as to damage the electrical characteristics of the switch contacts. Further, vapor phase or infrared reflow produced during the soldering processes can result in forming deposits on the contact surfaces, thereby impairing the performance of the switch.

Accordingly, there has been provided heretofore in the prior art slide switch constructions which are formed of a top assembly and a base assembly which remain in assembly independent of each other. There are disclosed in U.S. Pat. Nos. 4,072,839 and 4,139,746 switches which are generally illustrative of the type of electrical slide switches which include a base assembly defining terminal contacts and a top assembly including a slider and a bridging contactor. In particular, the top and bottom assemblies are shipped as separate items so that the user can attach the independent base assembly to a pc board or the like with the necessary soldering operation being carried out. Then, solvent or other cleaning mechanisms can be carried out so as to remove any contamination from contact surfaces. Finally, the top assembly is thereafter snapped into place with the base assembly so that the respective contact surfaces being now free of contamination will be readily operable. These types of prior art slide switches described in the '839 and '746 patents are referred to as so-called double pole-double throw construction.

However, over the years there has arisen a need for such types of electrical slide switches which are capable of switching an increased number of circuits than the "double pole" prior art, but yet still maintaining the advantages of being installed with contacts thereof being free of contamination. The present invention provides a PCB mounted 6PDT slide switch which includes a base member, a slide actuator member, movable contact shoes, a separate spacer bar member, and a cover member. The slide actuator member includes a fixed spacer bar element which is used to separate a first set of contact shoes from a second set of contact shoes. The separate spacer bar member is used to separate a third set of contact shoes from the second set of contact shoes.

SUMMARY OF THE INVENTION

Accordingly, it is a general object of the present invention to provide an improved slide switch of the socalled six pole-double throw construction which is relatively simple and economical to manufacture and assemble.

It is an object of the present invention to provide an improved PCB mounted 6PDT slide switch which greatly facilitates assembly and installation of the switch, but yet still maintains the advantages of being installed with contacts thereof being free of contamination.

Another object of the present invention is to provide a slide switch which is capable of switching an increased number of circuits than has been traditionally available.

It is still another object of the present invention to provide an improved PCB mounted 6PDT slide switch which can be easily installed, but yet permits cleaning of switch contacts so as to be free of contamination.

It is yet still another object of the present invention to provide an improved slide switch which is formed of a base member, a slide actuator member, movable contact shoes, a separate spacer bar member, and a cover member.

In accordance with these aims and objectives, the present invention is concerned with the provision of a slide switch which includes a base member having fixed therein spaced, substantially aligned first, second and third rows of terminal contacts. Each row is defined by first and second sets of terminal contacts. Each set has first, second and third contact pins. A slide actuator is formed of first and second T-shaped contact retention members and a fixed spacer bar element extending between the first and second retention members.

A first set of outer movable contact shoes are slidably mounted on the first and second retention members. A second set of intermediate movable contact shoes are slidably mounted on the first and second retention members and are separated from the first set of contact shoes by the fixed spacer bar element. A separate spacer bar member is slidably mounted on the first and second retention members. A third set of outer movable contact shoes are slidably mounted on the first and second retention members and are separated from the second set of contact shoes by the separate spacer bar member. A cover member is provided for retaining together the slide actuator, the first through third sets of contact shoes, and the separate spacer bar member. The cover member is fixedly secured to the base member.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein:

FIG. 1 is a perspective view of the slide switch, constructed in accordance with the principles of the present invention;

FIG. 2 is an exploded perspective view of the slide switch of the present invention;

DESCRIPTION OF THE PREFERRED EMBODIMENT

Figure 4:
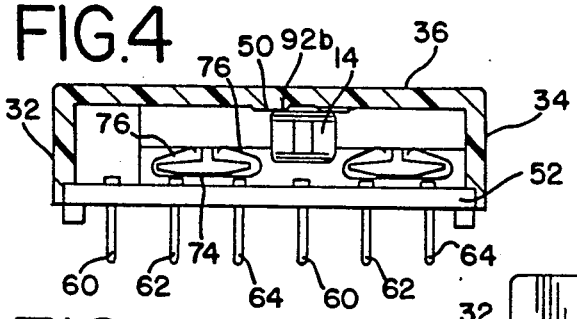
FIG. 4 is a cross-sectional view, similar to FIG. 3, but with the slide actuator in a second position thereof.

Referring now in detail to the various views of the drawings, there is illustrated in FIGS. 1 through 4 a PCB mounted six pole-double throw (6PDT) slide switch generally designated by reference numeral 10 which is constructed in accordance with the principles of the present invention. The slide switch 10 is comprised of a rectangularly-shaped housing or cover member 12, a slide actuator member 14 having a fixed spacer bar element 16, a separate spacer bar member 18, three sets of two movable contact shoes 20*a*, 20*b*, 22*a*, 22*b*, and 24*a*, 24*b*, and a base assembly 26.

Figure 9:
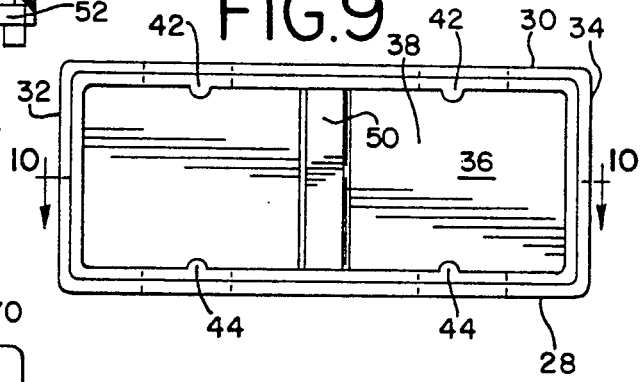
FIG. 9 is a bottom view of the cover member, taken along the lines 9—9 of FIG. 8.

The cover member 12 includes parallel side walls 28, 30, parallel end walls 32, 34, and a top wall 36. The housing is shown in FIGS. 1–4 and is illustrated in full detail in FIGS. 8–11. The cover member 12 is preferably integrally molded from a suitable nonconductive plastic material, such as, for example, a polycarbonate. The molded cover member 12 further contains a rectangular interior cavity 38 defined by means of the side and end walls 28–34 and is substantially open at its lower end. A central elongated aperture or opening 40 is formed within the side wall 30. As best seen from FIG. 9, a pair of inwardly extending projections or bumps 42 are formed on the inside surface of the side wall 30 adjacent opposite sides of the aperture 40, and a pair of inwardly extending projections or bumps 44 are formed on the inside surface of the side wall 28 disposed oppositely the respective bumps 42. A pair of slits 46 are also provided in the side wall 30 adjacent opposite sides of the aperture 40 and near the lower end of the side wall. A pair of slits 48 are similarly provided in the side wall 28 disposed oppositely the respective slits 46. The inside surface of the top wall 36 is provided with a central ridge 50 extending between the side walls 28 and 30.

Figure 5:
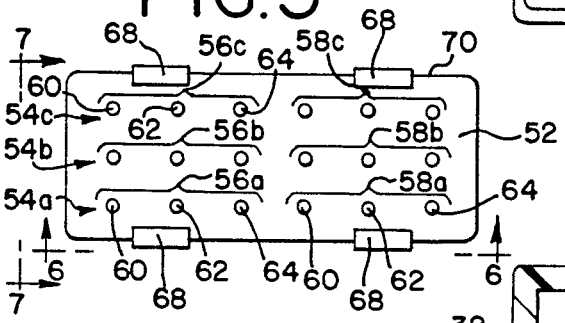
FIG. 5 is a top plan view of the base assembly of FIG. 2.
Figure 10:
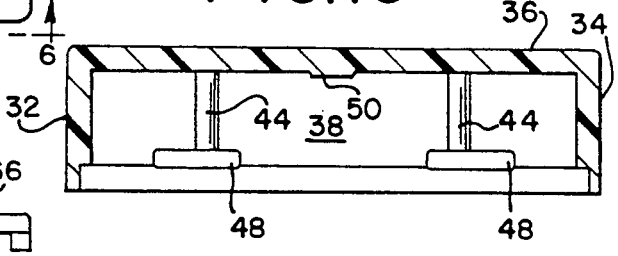
FIG. 10 is a cross-sectional view of the cover member, taken along the lines 10—10 of FIG. 9.
Figure 6:
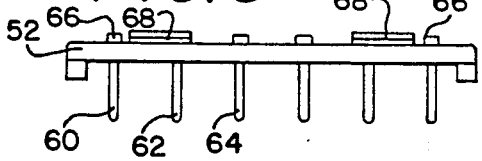
FIG. 6 is side view of the base assembly, taken along the lines 6—6 of FIG. 5.
Figure 11:
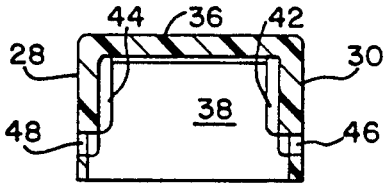
FIG. 11 is a cross-sectional view of the cover member, taken along the lines 11—11 of FIG. 9.
Figure 7:
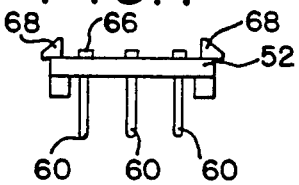
FIG. 7 is an end view of the base assembly, taken along the lines 7—7 of FIG. 5.
Figure 13:
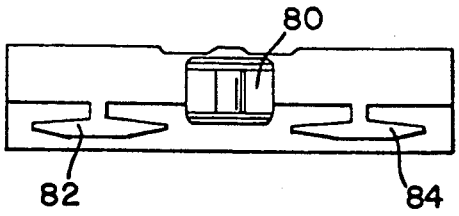
FIG. 13 is a left end view of the slide actuator member of FIG. 12.
Figure 16:
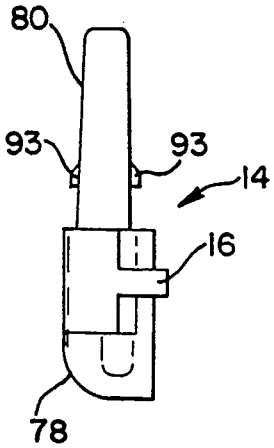
FIG. 16 is a side view of the slide actuator member of FIG. 12.
Figure 12:
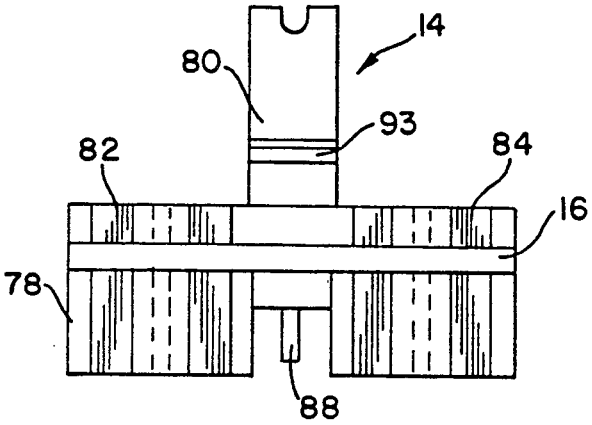
FIG. 12 is a front view of the slide actuator member of FIG. 2.
Figure 15:
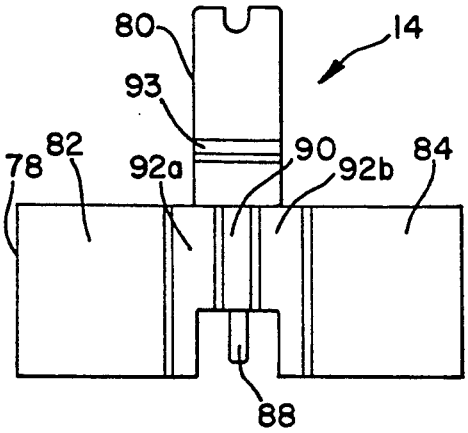
FIG. 15 is a back view of the slide actuator member of FIG. 12.
Figure 14:
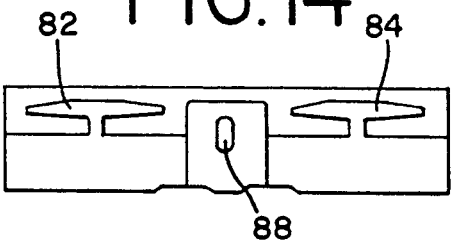
FIG. 14 is a right end view of the slide actuator member of FIG. 12.

The base assembly 26 is also preferably integrally molded from a suitable non-conductive plastic material, such as a polycarbonate. The base assembly is shown in FIGS. 1–4 and is illustrated in full detail in FIGS. 5—7. The base assembly is adapted and dimensioned to be received and secured in the interior cavity 38 of the cover member 12. The base assembly includes a rectangularly-shaped plate member 52 having secured therein three parallel rows 54*a*, 54*b*, and 54*c* of longitudinally spaced fixed terminal contacts. The first row 54*a* includes first and second sets 56*a*, 58*a* of fixed terminal contacts each set being formed of first, second and third contact pins 60, 62 and 64, respectively. The second row 54*b* includes first and second sets 56*b*, 58*b* of fixed terminal contacts each set being formed of first, second and third contact pins 60–64 respectively. Similarly, the third row 54*c* includes first and second sets 56*c*, 58*c* of fixed terminal contacts each set being formed of respective first, second and thirds contact pins 60–64. In this manner, the six sets of fixed terminal contacts define a six pole-double throw switch construction. The contact pins 60–64 are rigidly secured within the plate 52 such as, for example, by means of staking or any other desired method.

Figure 3:
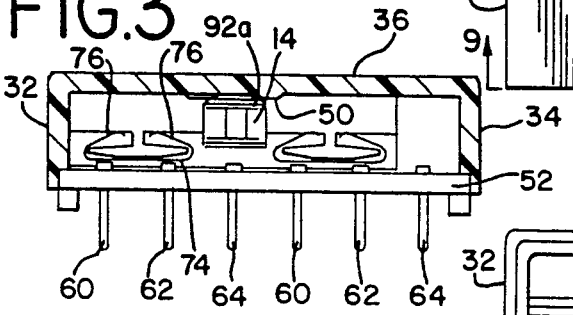
FIG. 3 is a cross-sectional view, taken along the lines 3—3 of FIG. 1 with the slide actuator in a first position thereof.
Figure 8:
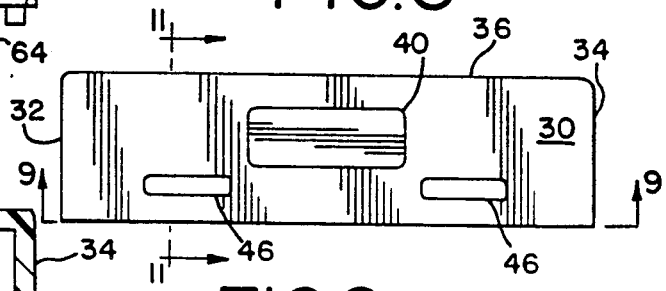
FIG. 8 is a side elevational view of the cover member of FIG. 2.

The first, second and third contact pins 60–64 of the respective six sets of terminal contacts (56*a*, 58*a*, 56*b*, 58*b*, 56*c*, 58*c*) are preferably formed from a suitable conductive metallic material such as silver-coated copper alloy. Each of the contact pins has a head portion 66 which projects upwardly slightly above the surface of the plate member 52 when they are assembled to form the base assembly 26. The head portions 66 are preferably made of a substantially smooth, rounded configuration so as to enable the movable contact shoes 20*a*, 20*b*, 22*a*, 22*b*, and 24*a*, 24*b* to effectively pass whereover as the slide switch 10 is moved between a first position as illustrated in FIG. 3 and a second position as illustrated in FIG. 4. The base assembly further includes four lock tabs 68 formed adjacent the side edges 70 and 72 of the plate member 52 which are engageable with the slits 46 and 48 on the side walls 28 and 30 of the cover member 12, thereby securing interlockingly the base assembly 26 to the cover member 12.

The three sets of two movable contact shoes 20*a*, 20*b*, 22*a*, 22*b*, and 24*a*, 24*b* are preferably made from a suitable resilient conductive sheet metal material, such as a silver-coated copper alloy. Each movable contact shoe includes an elongated contacting portion 74 and a pair of inwardly sloping spring arms 76 which converge toward each other from opposite ends of the contacting portion 74. The movable contact shoes are mounted on the slide actuator member 14 so that the contacting portions 74 thereof are in abutting engagement with the first and second sets of fixed terminal contacts in each of the three rows 54*a*–54*c*.

The slide actuator member 14 is preferably also integrally molded from a suitable non-conductive plastic material, such as a polycarbonate. The slide actuator member is shown in FIGS. 1–4 and is illustrated in full detail in FIGS. 12–16. The slide actuator member includes a rectangularly-shaped slide body portion 78 and a button portion 80 extending outwardly from one side of the body portion in its intermediate area. The body portion 78 includes first and second T-shaped contact retention members 82, 84 disposed on its one side which are dimensioned for receiving and positioning the movable contact shoes to be aligned with the respective first and second sets of fixed terminal contacts in each of the three rows. The body portion 78 further includes the fixed spacer bar element 16 formed integrally thereon which extends between the first and second retention members 82 and 84. The body portion also has a central mounting post 88 which is disposed opposite the button portion 80. On the other side of the body portion, there are provided a central raised portion 90 and a pair of recesses 92*a*, 92*b* formed on each side of the raised portion 90. The recess 92*a* is used to engage and retain the central ridge 50 of the cover member in the first position, and the recess 92*b* is used to engage and retain the central ridge 50 of the cover member in the second position.

The button portion 80 served to provide for manual operation of the slide switch 10. A pair of nibs 93 extend outwardly from opposite to and bottom surfaces of the button portion. The opening 40 in the cover member 12 has substantially the same dimension as the distance between the top and bottom surfaces of the button portion 80. The nibs 93 are adapted to be forced beyond the opening 40 so that they serve a means for holding the slide actuator member 14 and the cover member 12 together.

Figure 17:
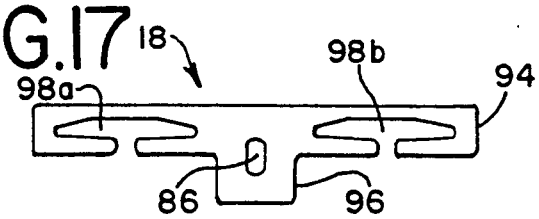
FIG. 17 is a side view of the separate spacer bar member of FIG. 2.

The separate spacer bar member 18 is likewise preferably molded from a suitable non-conductive plastic material such as a polycarbonate. As best seen from FIG. 17, the separate spacer bar member includes a narrow body element 94 and a connecting member 96 extending downwardly from the intermediate area of the body element 94. The body element includes first and second contoured openings 98*a*, 98*b* disposed adjacent each end which are dimensioned for receiving the T-shaped retention members 82, 84 on the body portion 78 of the slide actuator member 14. The connecting member 96 includes a central aperture 86 which is mounted onto the mounting post 88 on the body portion 78 of the slide actuator member 14.

Figure 18:
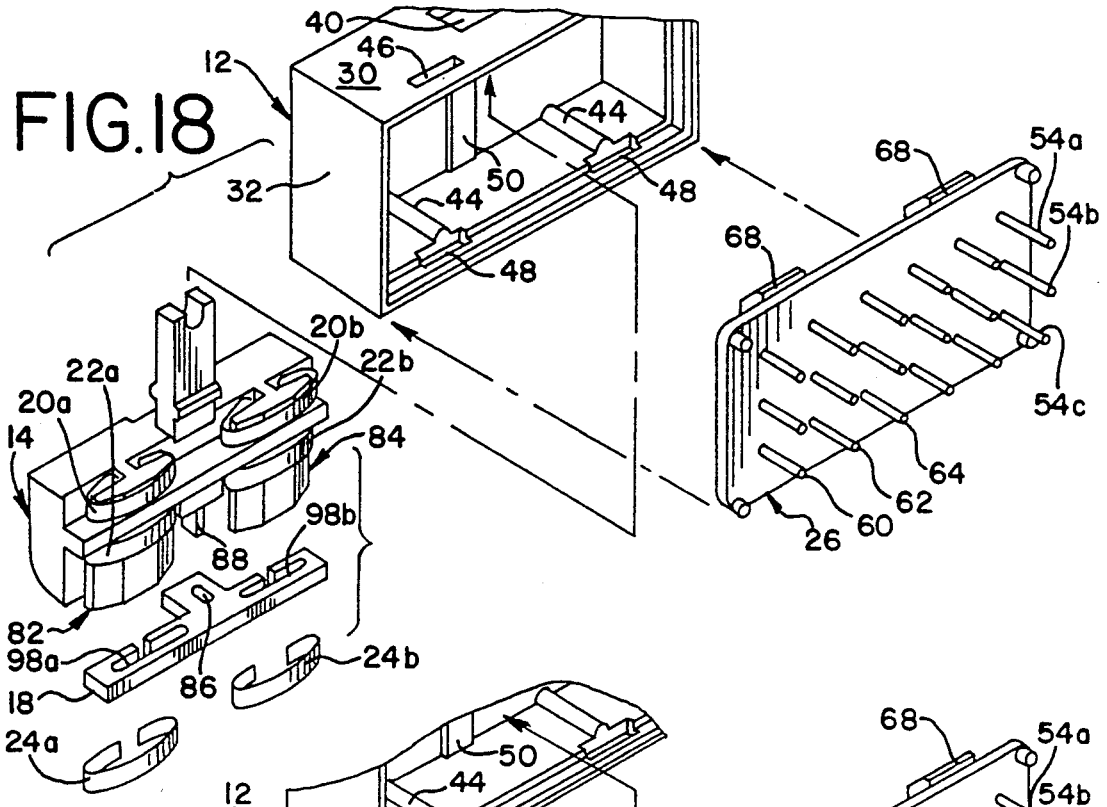
FIGS. 18, 19 and 20 are perspective views, illustrating the various stages of assembly of the slide switch of the present invention.
Figure 19:
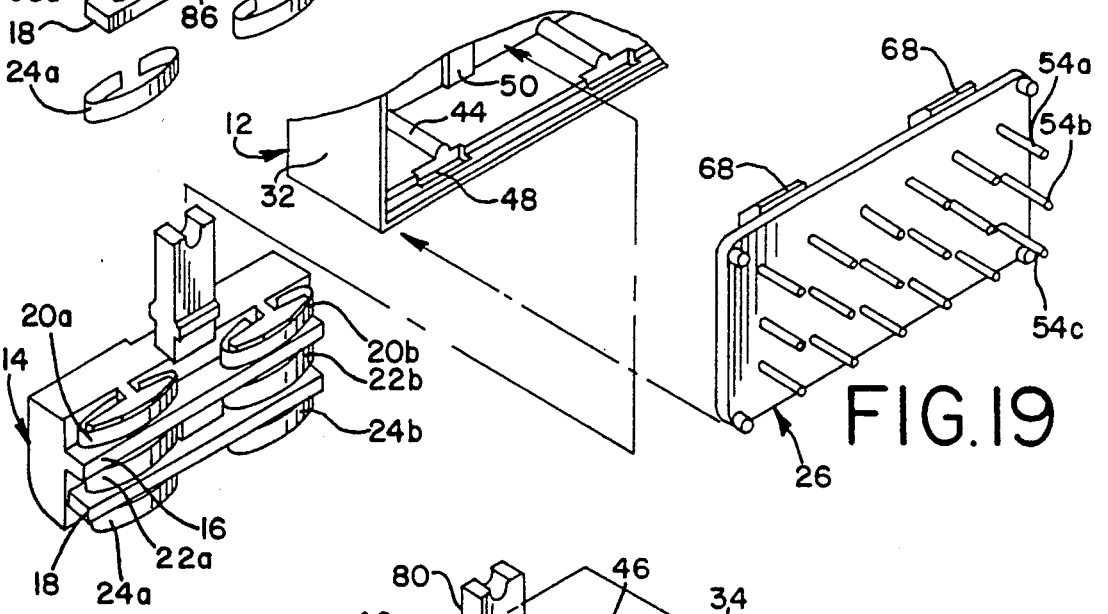

In assembly, the first set (outer) of the two movable contact shoes 20*a*, 20*b* are slidably mounted on the T-shaped contact retention members 82, 84 of the body portion 78 of the slide actuator member 14. Then, the second set (intermediate) of the two movable contact shoes 22*a*, 22*b* are slidably mounted on the same T-shaped retention members 82, 84 and are segregated from the first set of contact shoes (20*a*, 20*b*) by the fixed spacer bar element 16, as illustrated in FIG. 18. Next, the separate spacer bar member 18 is mounted on the slide actuator member so that the contoured openings 98*a*, 98*b* thereof receive the same T-shaped retention members 82, 84 and the central aperture 86 thereof receives the mounting post 88, thereby laterally retaining the second set of contact shoes (22*a*, 22*b*) between the fixed spacer bar element 16 and the separate spacer bar member 18. The third set (outer) of the two movable contact shoes 24*a*, 24*b* are then slidably mounted on the same T-shaped retention members 82, 84 and are segregated from the second set of contact shoes (22*a*, 22*b*) by the separate spacer bar member, as illustrated in FIG. 19.

Figure 20:
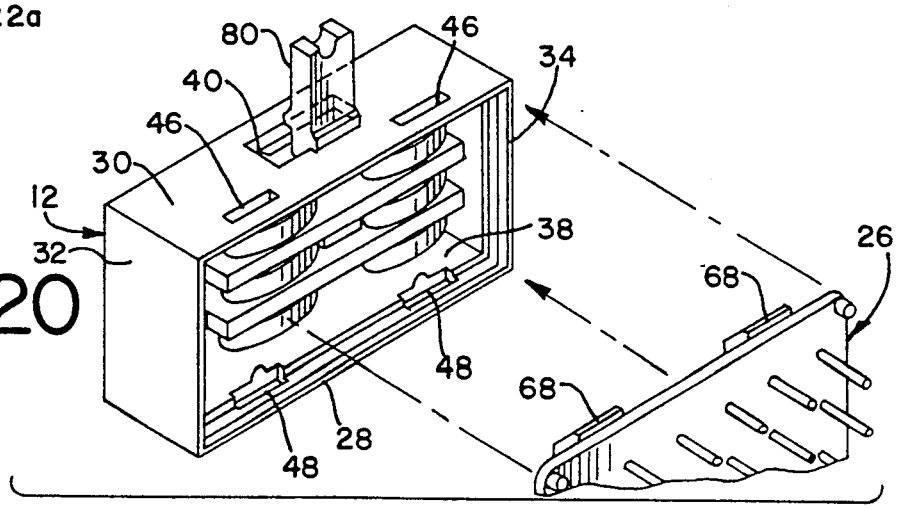

Finally, the slide actuator member 14 with the separate spacer bar member 18 and the three sets of two movable contact shoes are inserted into the interior cavity 38 of the cover member 12 so that the button portion 80 projects outwardly through the opening 40, as illustrated in FIG. 20. It will be noted that the first and third sets of outer movable contact shoes are axially retained by the interior side surfaces of the side walls 28, 30 of the cover member 12 In this manner, the cover/actuator sub-assembly is thus formed separately from the base assembly 26 of the slide switch so that they remain independent of each other.

Accordingly, the independent base assembly 26 is first attached to a printed circuit board or otherwise included in an electrical circuit with the necessary soldering operations being independently carried out. At this point, solvents or other cleaning mechanisms can be utilized so as to remove any contamination from the contact surfaces. The sub-assembly of the cover member 12, slide actuator member 14, separate spacer bar member 18, and the six sets of movable contact shoes 20*a*, 20*b*, 22*a*, 22*b*, and 24*a*, 24*b* can then be readily snapped together with the locking tabs 68 being received in the respective slits 46 and 48. There has been eliminated contamination of the contact shoes by flux or other problems associated with wave soldering of the contact pins on the base assembly to the circuit board if the slide switch was soldered in a completely assembled unit.

Having now described the construction and assembly of the slide switch as shown in FIGS. 1 through 20, its operation will now be explained. The button portion 80 of the slide actuator member 14 is alternatively positionable in the first position illustrated in FIG. 3 or the second position illustrated in FIG. 4. As shown in FIG. 3, when the button portion 80 of the slide actuator member has been slidably moved to the fully left endmost position (first position), the contacting portion 74 of the first set of movable contact shoes 20*a* and 20*b* are in electrical bridging engagement with the respective first and second contact pins (60, 62) of the first and second sets of terminal contacts (56*a*, 58*a*) in the first row 54*a* of the base assembly 26. The contacting portion 74 of the second set of movable contact shoes 22*a* and 22*b* are also in electrical bridging engagement with the respective first and second contact pins (60, 62) of the first and second sets of terminal contacts (56*b*, 58*b*) in the second row 54*b* of the base assembly. Similarly, the contacting portions 74 of the third set of movable contact shoes 24*a* and 24*b* are in electrical bridging engagement with the respective first and second contact pins (60, 62) of the first and second sets of terminal contacts (56*c*, 58*c*) in the third row 54*c* of the base assembly. Further, the central ridge 50 of the cover member is received in the recess 92*a* so as to releasably retain the slide actuator member in the first position thereof.

As the slide actuator member is moved to the fully right endmost position (second position), the contacting portions 74 of the first set of movable contact shoes 20*a* and 20*b* are transferred so as to be in electrical bridging engagement with the respective second and third contact pins (62, 64) of the first and second set of terminal contacts (56*a*, 58*a*) in the first row 54*a* of the base assembly. The contacting portions 74 of the second set of movable contact shoes 22*a* and 22*b* are also in electrical bridging engagement with the respective second and third contact pins (62, 64) of the first and second set of terminal contacts (56*b*, 58*b*) in the second row 54*b* of the base assembly. Similarly, the contacting portions 74 of the third set of movable contact shoes 24*a* and 24*b* are in electrical bridging engagement with the respective second and third contact pins (62, 64) of the first and second sets of terminal contacts (56*c*, 58*c*) in the third row 54*c* of the base assembly. Further, the central ridge 50 of the cover member is received in the recess 92*b* so as to releasably retain the slide actuator member in the second position thereof.

From the foregoing detailed description, it can thus be seen that the present invention provides an improved slide switch which includes a base member, a slide actuator member, a plurality of movable contact shoes, a separate spacer bar member, and a cover member. The switch construction greatly facilitates assembly and installation of the present slide switch, but yet still maintains the advantages of being installed with the contact shoes thereof being free of contamination.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A slide switch comprising:

a base member having fixed therein spaced, substantially aligned first, second and third rows of terminal contacts, each row being defined by first and second sets of the terminal contacts, each set having first, second and third contact pins;

slide actuator means being formed of first and second T-shaped contact retention members and a fixed spacer bar element extending between said first and second retention members;

a first set of outer movable contact shoes being slidably mounted on said first and second retention members;

a second set of intermediate movable contact shoes being slidably mounted on said first and second retention members and being spaced from said first set of contact shoes by said fixed spacer bar element;

a separate spacer bar member being slidably mounted on said first and second retention members;

a third set of outer movable contact shoes being slidably mounted on said first and second retention members and being separated from said second set of contact shoes by said separate spacer bar member; and a cover member for retaining together said slide actuator means, said first through third sets of contact shoes and said separate spacer bar member, said cover member being fixedly secured to said base member such that said contact shoes are electrically connected with a selected number of said terminal contacts.

2. A slide switch as claimed in claim 1, wherein said slide actuator means is movable between a first position in which said first, second and third sets of movable contact shoes are in electrical merging engagement with said first and second contact pins of said first and second sets of terminal contacts in said first, second and third rows and a second position in which said first, second and third sets of movable contact shoes are in electrical bridging engagement with said second and third contact pins of said first and second sets of terminal contacts in said first, second and third rows.

3. A slide switch as claimed in claim 2, wherein said cover member includes a central ridge which is alternatively engageable with first and second recesses formed on said slide actuator means for releasably retaining said slide actuator means in one of the first and second positions.

4. A slide switch as claimed in claim 1, wherein each of said movable contact shoes includes a contacting portion and a pair of inwardly sloping spring arms which converge towards each other from opposite ends of the contacting portion.

5. A slide switch as claimed in claim 1, wherein each of said movable contact shoes is formed of a suitable resilient conductive sheet metal material.

6. A slide switch as claimed in claim 1, wherein said cover member includes a rectangularly-shaped housing having side walls, end walls, and a top wall, said housing being substantially open at its lower end for receiving said base member.

7. A slide switch as claimed in claim 1, wherein said slide actuator means includes a button portion extending through an opening formed in said cover member and being operated in a sliding mode of operation.

8. A slide switch as claimed in claim 1, wherein said base member includes a plurality of tabs for interlocking engagement with slits formed on said cover member so as to fixedly secure said base member to said cover member.

9. A slide switch as claimed in claim 1, wherein said separate spacer bar member includes a narrow body element and a connecting member extending outwardly from an intermediate area of the body element, said body element having contoured openings formed therein for receiving said first and second T-shaped retention members of said slide actuator means and said connecting members having a central aperture which is disposed onto a mounting post formed on said slide actuator means.

10. A slide switch actuator comprising:

slide actuator means being formed of first and second T-shaped contact retention members and a fixed spacer bar element extending between said first and second retention members;

a first set of outer movable contact shoes being slidably mounted on said first and second retention members;

a second set of intermediate movable contact shoes being slidably mounted on said first and second retention members and being spaced from said first set of contact shoes by said fixed spacer bar element;

a separate spacer bar member being slidably mounted on said first and second retention members;

a third set of outer movable contact shoes being slidably mounted on said first and second retention members and being separated from said second set of contact shoes by said separate spacer bar member; and a cover member for retaining together said slide actuator means, said first through third sets of contact shoes and said separate spacer bar member.

11. A slide switch as claimed in claim 10, wherein said cover member includes a central ridge which is alternatively engageable with first and second recesses formed on said slide actuator means for releasably retaining said slide actuator means in one of the first and second positions.

12. A slide switch as claimed in claim 10, wherein each of said movable contact shoes includes a contacting portion and a pair of inwardly sloping spring arms which converge towards each other from opposite ends of the contacting portion.

13. A slide switch as claimed in claim 10, wherein each of said movable contact shoes is formed of a suitable resilient conductive sheet metal material.

14. A slide switch as claimed in claim 10, wherein said cover member includes a rectangularly-shaped housing having side walls, end walls, and a top wall, said housing being substantially open at its lower end for receiving a base member.

15. A slide switch as claimed in claim 10, wherein said slide actuator means includes a button portion extending through an opening formed in said cover member and being operated in a sliding mode of operation.

16. A slide switch as claimed in claim 14, wherein said base member includes a plurality of tabs for interlocking engagement with slits formed on said cover member so as to fixedly secure said base member to said cover member.

17. A slide switch as claimed in claim 10, wherein said separate spacer bar member includes a narrow body element and a connecting member extending outwardly from an intermediate area of the body element, said body element having contoured openings formed therein for receiving said first and second T-shaped retention members of said slide actuator means and said connecting member having a central aperture which is disposed onto a mounting post formed on said slide actuator means.

18. A slide switch actuator comprising:

slide actuator means being formed of first and second T-shaped contact retention members and a fixed spacer bar element extending between said first and second retention members;

first movable contact shoes means being slidably mounted on said first and second retention members;

second movable contact shoes means being slidably mounted on said first and second retention members and being spaced from said first contact shoes means by said fixed spacer bar element;

a separate spacer bar member being slidably mounted on said first and second retention members; and third movable contact shoes means being slidably mounted on said first and second retention members and being separated from said second contact shoes means by said separate spacer bar member.

19. A slide switch as claimed in claim 18, wherein said separate spacer bar member includes a narrow body element and a connecting member extending outwardly from an intermediate area of the body element, said body element having contoured openings formed therein for receiving said first and second T-shaped retention members of said slide actuator means and said connecting member having a central aperture which is disposed onto a mounting post formed on said slide actuator means.

20. A slide switch as claimed in claim 19, wherein said first, second and third movable contact shoes means include a contacting portion and a pair of inwardly sloping spring arms which converge towards each other from opposite ends of the contacting portion.

* * * * *